US009206632B1

(12) United States Patent
Fields

(10) Patent No.: US 9,206,632 B1
(45) Date of Patent: Dec. 8, 2015

(54) SAFETY GATE HINGE ASSEMBLY USED WITH A SAFETY GATE

(71) Applicant: Jerry Nicholas Fields, Dalla, GA (US)

(72) Inventor: Jerry Nicholas Fields, Dalla, GA (US)

( * ) Notice: Subject to any disclaimer, the term of this patent is extended or adjusted under 35 U.S.C. 154(b) by 0 days.

(21) Appl. No.: 14/216,443

(22) Filed: Mar. 17, 2014

Related U.S. Application Data

(60) Provisional application No. 61/794,201, filed on Mar. 15, 2013.

(51) Int. Cl.

| | |
|---|---|
| ***E05B 65/04*** | (2006.01) |
| ***E05D 7/00*** | (2006.01) |
| ***E05D 15/00*** | (2006.01) |
| ***E04H 17/00*** | (2006.01) |
| *E06B 9/01* | (2006.01) |

(52) U.S. Cl.
CPC *E05D 7/00* (2013.01); *E04H 17/00* (2013.01); *E05D 15/00* (2013.01); *E05D 2700/00* (2013.01); *E06B 2009/015* (2013.01)

(58) Field of Classification Search
CPC ..... E05D 7/00; E05D 15/00; E04H 17/00
USPC ..... 49/61, 62, 63, 65, 67, 50, 56, 73.1, 98, 49/142, 463, 465
See application file for complete search history.

(56) References Cited

U.S. PATENT DOCUMENTS

| | | | | |
|---|---|---|---|---|
| 155,911 | A | | 10/1874 | Wissler |
| 708,441 | A | | 9/1902 | Williams et al. |
| 1,497,694 | A | | 6/1924 | Neff, Sr. |
| 1,821,606 | A | | 9/1931 | Anderson |
| 2,537,896 | A | * | 1/1951 | Hinton et al. ..... 292/1 |
| 2,975,830 | A | * | 3/1961 | McDonald ..... 160/92 |
| 3,738,062 | A | | 6/1973 | Ughi |
| 3,872,623 | A | * | 3/1975 | Spaulding, Jr. ..... 49/169 |
| 3,947,997 | A | * | 4/1976 | Mursula ..... 49/62 |
| 4,272,934 | A | * | 6/1981 | Cowden et al. ..... 52/202 |
| 4,302,907 | A | * | 12/1981 | Canals et al. ..... 49/65 |
| 4,389,817 | A | * | 6/1983 | Olberding ..... 49/163 |
| 4,409,758 | A | * | 10/1983 | Dickerson et al. ..... 49/463 |
| 4,592,180 | A | * | 6/1986 | Gerritsen ..... 52/203 |
| 4,884,614 | A | | 12/1989 | Spurling |
| 4,891,906 | A | | 1/1990 | Knapp |
| 5,457,914 | A | | 10/1995 | Johnson, Jr. |
| 5,535,550 | A | * | 7/1996 | Yang ..... 49/163 |
| 5,570,543 | A | | 11/1996 | Bishop |
| 5,630,191 | A | | 5/1997 | Hasuda |
| 5,860,250 | A | | 1/1999 | Hill et al. |
| 5,927,011 | A | | 7/1999 | Sickenius |

(Continued)

FOREIGN PATENT DOCUMENTS

| | | | |
|---|---|---|---|
| DE | 3915502 | A1 | 11/1990 |
| JP | 2003314126 | A | 11/2003 |
| JP | 2005061095 | A | 3/2005 |

OTHER PUBLICATIONS

Safety 1st Nature Next Bamboo Gate found at Amazon.com: http://www.amazon.com/Safety-1st-Naure-Next-Bamboo/ddp/B001PYQWXY/ref=Sr.

*Primary Examiner* — Jerry Redman
(74) *Attorney, Agent, or Firm* — Smith, Gambrell & Russell LLP

(57) ABSTRACT

A safety gate assembly includes a safety gate hinge bracket that works with a safety gate or door to allow secure mounting of the safety gate within a conventional door jamb connected to a conventional and existing door hinge.

15 Claims, 10 Drawing Sheets

(56) References Cited

U.S. PATENT DOCUMENTS

| | | | | |
|---|---|---|---|---|
| 6,016,629 | A | 1/2000 | Sylvester et al. | |
| 6,109,328 | A * | 8/2000 | Montana et al. | 160/92 |
| 6,526,694 | B1 * | 3/2003 | Cosgrove | 49/67 |
| 6,941,997 | B2 * | 9/2005 | Butler | 160/92 |
| 8,191,205 | B2 | 6/2012 | Forrest | |
| 8,607,503 | B2 * | 12/2013 | Ivie | 49/67 |
| 2003/0101652 | A1 * | 6/2003 | Cosgrove | 49/63 |
| 2007/0113478 | A1 * | 5/2007 | Chu et al. | 49/67 |
| 2013/0269258 | A1 * | 10/2013 | Koch et al. | 49/67 |

* cited by examiner

SAFETY GATE HINGE ASSEMBLY USED WITH A SAFETY GATE

CROSS-REFERENCE TO RELATED APPLICATION

This application claims priority from provisional patent application No. 61/794,201, filed on Mar. 15, 2013, which is herein incorporated by reference in its entirety.

BACKGROUND

1. Field of the Invention

A safety gate assembly including a safety gate hinge bracket for use with a safety gate to secure and protect pets and children in a desired location and constrain travel from the location blocked by the gate.

2. Description of the Related Art

There are various means and techniques that are used to form barriers or to close an area, such as stairways or doorways, in order to limit or confine a child or pet to a particular area of a home so as to prevent accidents. A variety of different safety gates that are known in the art. For example, there is a protector gate formed with lazy-tong fences that is expansible to fit a desired space, as illustrated in the following U.S. Pat. Nos. 4,523,745, and 4,723,587. In addition, there are safety gates that are telescopically adjustable to be held into place solely through a wedging, jamming, or pressure action, as described in U.S. Pat. Nos. 4,492,263, and 3,431,966, which are incorporated herein by reference. Further, there are known security gates that are freestanding, such as U.S. Pat. No. 4,984,619.

While such gates might provide some security for the user, there are multiple concerns associated with their use. For example, one concern is the structural security of the attachment of the gate to the wall, baluster, or stair-rail. A gate that relies upon forces from the wedged placement is dependent on pressure against a vertical surface, such as a door jamb, and may fail due to general mechanical issues or a simple push from the child or pet if the wedged forces are not sufficient to overcome other forces. Moreover, there are doorframes and similar areas that might not accommodate these safety gates. In addition, wedging the safety gate in a door jamb might lead to cosmetic damage to the associated area.

SUMMARY OF THE INVENTION

A safety gate assembly includes a safety gate hinge assembly used with a safety gate or door to allow secure mounting of the safety gate within a conventional door jamb connected to a conventional and existing door hinge. The safety gate hinge assembly includes a safety gate hinge bracket and an extended hinge pin. The safety gate bracket has a first plate to engage a door jamb and a second plate to engage a safety gate. The first and second plates are positioned substantially a right angle to each other. At least two hinge connectors are attached to the second plate so that one hinge connector may be positioned above the door hinge and the second hinge connector positioned below the door hinge. The extended hinge pin replaces the existing door hinge pin and extends through the hinge connectors and the door hinge. The safety gate may thereafter pivot within the door frame about the existing door hinge independently of the door to provide the desired security for the user.

DESCRIPTION OF THE PREFERRED EMBODIMENTS

Figure 1:
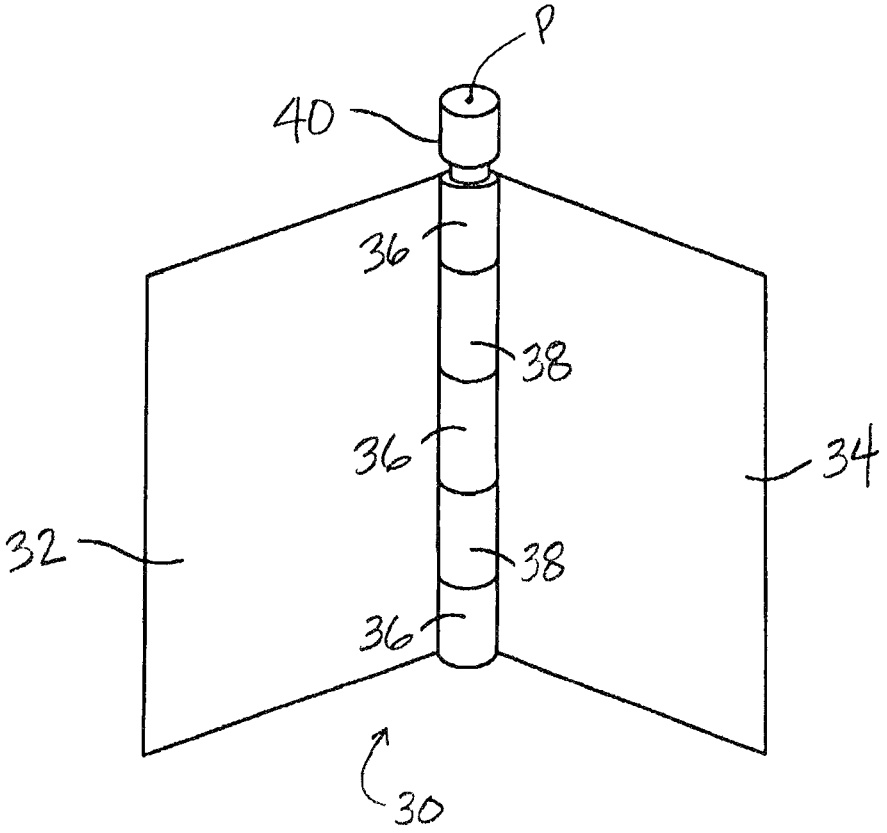
Fig. 1 (Prior Art)
FIG. 1 is a perspective view of a conventional door hinge known in the art.

A safety gate assembly 100 is illustrated in FIGS. 2-13 and described herein for use with a conventional and existing door hinge 30 as shown in FIG. 1. The safety gate assembly 100 includes a safety gate hinge bracket 110 that works with a safety gate or door 120 to allow secure mounting of the safety gate 120 within a conventional door jamb 20 connected to a conventional and existing door hinge 30.

As a bit of background, doors 10 are conventionally secured to a door frame or door jamb 20 (used herein interchangeably) via multiple hinges 30, with the hinges 30 holding the door 10 position as the door 10 opens and closes. Conventional door hinges 30, as illustrated in FIG. 1, include two hinge plates 32, 34 with the first hinge plate 32 having a series of first knuckles 36 along an inner edge of the first hinge plate 32 and the second hinge plate 34 having a series of second knuckles 38 along an inner edge of the second hinge plate 34. The first and second knuckles 36, 38 in the illustrated embodiment are connected to each corresponding hinge plate 32, 34 with gaps between each respective knuckle 36 or knuckle 38, so that when the hinge plates 32, 34 are joined, the knuckles 36, 38 are provided in an alternating fashion, with the second knuckles 38 positioned between the first knuckles 36. A door hinge pin or rod 40 then extends through knuckles 36, 38 to pivotally join the two hinge plates 32, 34. One hinge plate 32 is fixedly attached to the door frame 20 while the other hinge plate 34 is fixedly attached to the door 10. The inserted hinge pin 40 provides the door hinge 30 with a pivot point P about which the door 10 can open and close within the door jamb 20. The knuckles 36, 38 thereby rotate relative to each other and contact the hinge pin 40 as the door 10 moves. Once multiple hinges 30 are connected between the door 10 and door frame 20, the door 10 is free to rotate between a closed position abutting the door frame 20 and an opened position rotated away from the door frame 20.

The safety gate assembly 100 with the safety gate hinge assembly 108 described herein is used with the conventional door hinge 30 and door jamb 20 as described above. The safety gate 120 is simply a partition or barrier known in the art that typically has a rectangular shape and may include multiple connected barriers that may be extended relative to each other to fill in the space of the door frame as desired. It is further foreseen that the safety gate 120 could also take the form of a screen door used in connection with the conventional door 10, although minor amendments might need to be made to the embodiment for such use, such as using multiple safety gate hinge brackets 110 to support the door 10.

Figures 2, 2A, 2B:
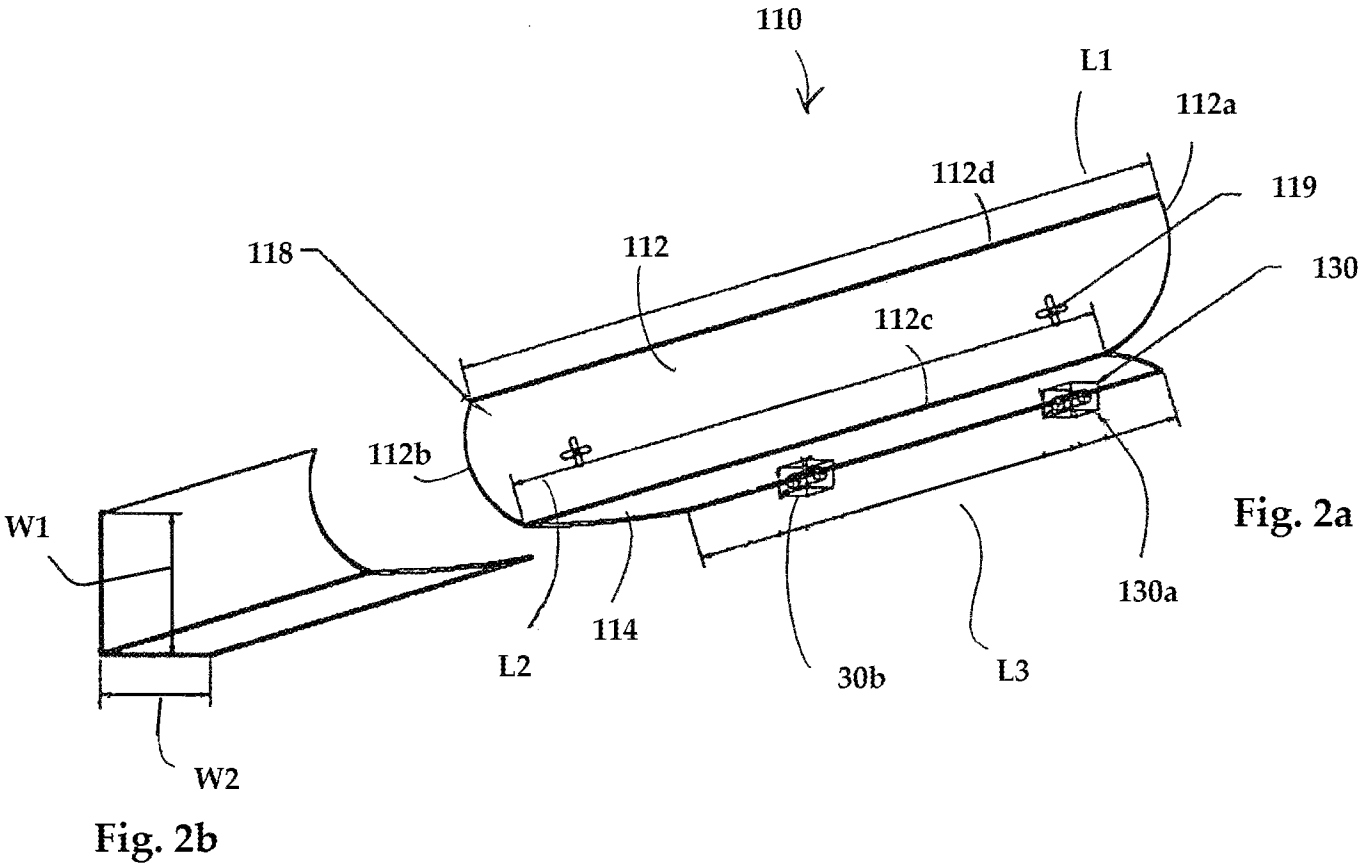
FIG. 2 includes FIG. 2*a*, a perspective view of an embodiment of the safety gate hinge bracket of the safety gate hinge assembly, and FIG. 2*b*, providing additional dimensions of the safety gate hinge bracket.
Figure 4:
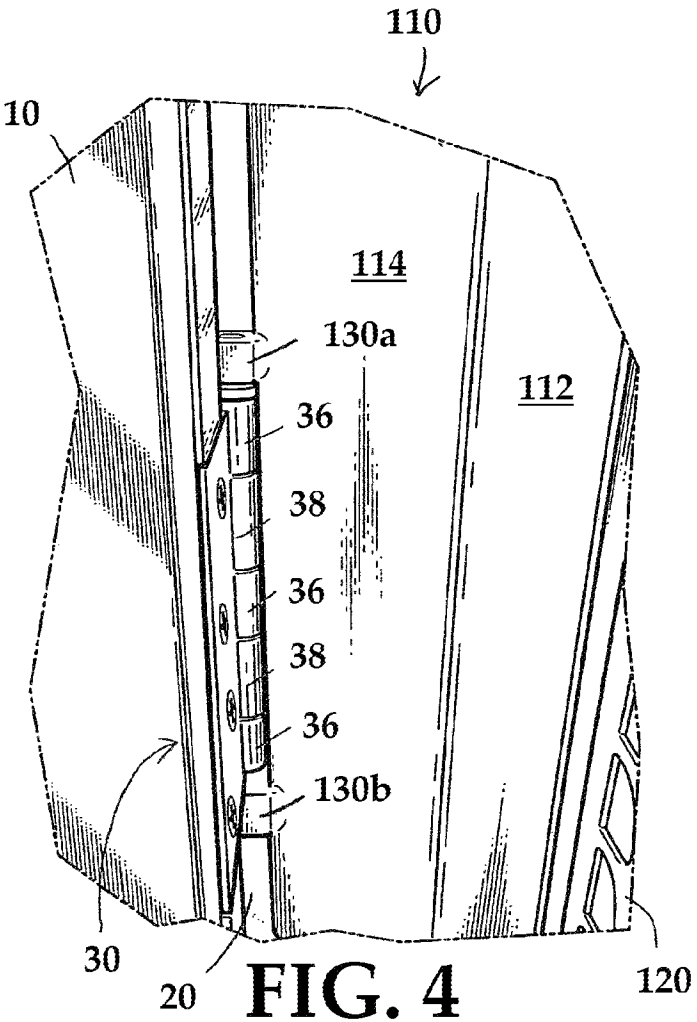
FIG. 4 is a magnified perspective view of the safety gate hinge assembly engaging a doorjamb.
Figure 3:
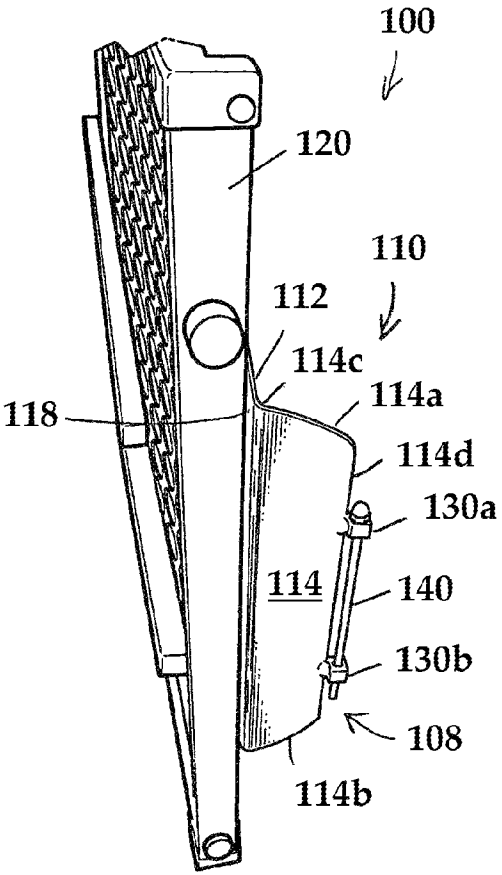
FIG. 3 is a first perspective view of the safety gate hinge assembly having another embodiment of the safety gate hinge bracket.
Figure 5:
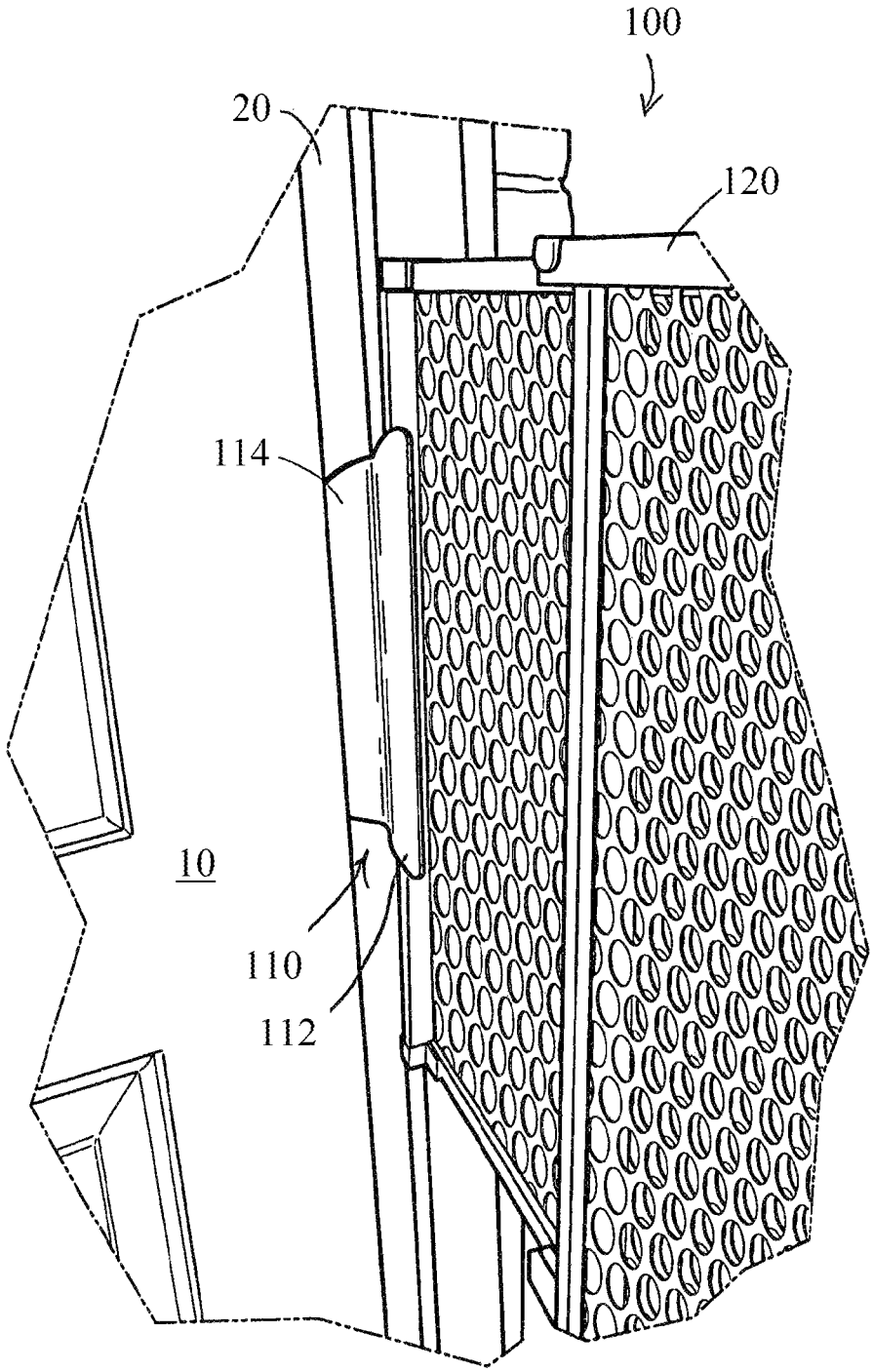
FIG. 5 is a perspective view of the safety gate hinge assembly engaging a door jamb.
Figure 7:
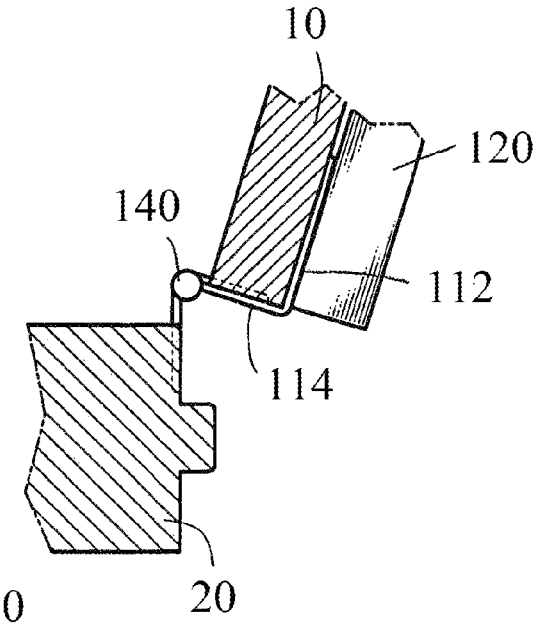
FIG. 7 is a top cutaway view of the safety gate hinge assembly engaging a door and doorjamb.
Figure 6:
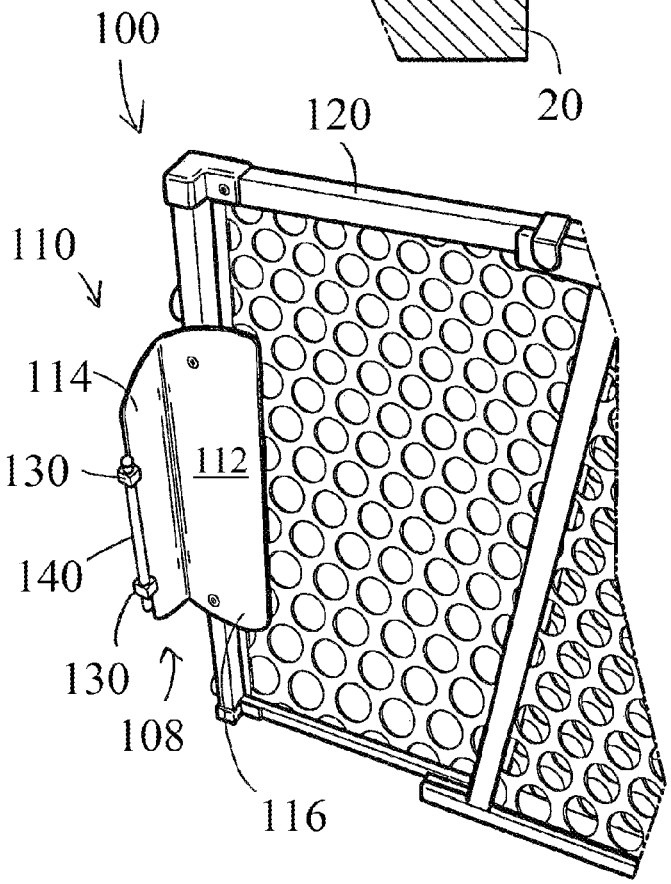
FIG. 6 is a second perspective view of the safety gate hinge assembly.

Looking to FIGS. 2 and 3, the safety gate hinge assembly 108 includes a safety gate hinge bracket 110. The safety gate hinge bracket 110 in the illustrated embodiment is formed from a strong and rigid material, such as stainless steel, that is able to securely support the safety gate 120. While the safety gate hinge bracket 110 may be formed of a single sheet of a material or two separate sheets of a material that are rigidly connected, it may be described as having two combined plates; namely, a first hinge plate 112 and a second hinge plate 114. The first and second hinge plates 112, 114 may be of various shapes and sizes (see FIGS. 2, 3, 6, 11 and 13). In the illustrated embodiments, the first hinge plate 112 has four general edges: a top edge 112*a*, bottom edge 112*b*, inner edge 112*c* and outer edge 112*d*. In one embodiment, the length L1 of the outer edge 112*d* is 13 inches and the length L2 of the inner edge 112*c* is 11 inches, with the outer edge 112*d* being separated from the inner edge 112*c* by 2.5 inches. The upper and lower edges 112*a*, 112*b* have a curved or arced surface connecting the outer edge 112*d* with the inner edge 112*c*. Likewise, the second hinge plate 114 has four general edges: a top edge 114*a*, bottom edge 114*b*, inner edge 114*c* and outer edge 114*d*. In one embodiment, the length L2 of the outer edge 114*d* is 11 inches and the length L3 of the inner edge 114*c* is 9 inches, with the outer edge 114*d* being separated from the inner edge 114*c* by 2 inches. The upper and lower edges 112*a*, 112*b* have a curved or arced surface connecting the outer edge 112*d* with the inner edge 112*c*. The first and second plates 112, 114 are joined together along the respective inner edges 112*c*, 114*c* and generally at a right angle with respect to each other, with the hinge plates 112, 114 of the L-shaped bracket having an inner surface 116 and an outer surface 118. As a result, the safety gate hinge bracket 110 is generally an L-shaped bracket.

Looking to FIGS. 6 and 8-11, the first hinge plate 112 is connected to the safety gate 120 using any of a variety connectors known in the art, such as screws, nails, or glue. In such fashion, the outer surface 118 of the first hinge plate 112 will substantially abut the safety gate 120. Moreover, the position of the safety gate 120 may be adjusted along the length L1 and width W1 of the outer surface 118 of the first hinge plate 112 so that it will easily abut a door jamb extension 21 but not conflict with the position of the door jamb extension 21. Looking to FIG. 2, two adjustable screw slots 119 are illustrated in the safety gate hinge bracket 110. The screw slots 119 provide flexibility to the user by allowing the user to reposition the safety gate hinge bracket 110 within the slots 119 after the safety gate hinge bracket 110 has been secured to the safety gate 120.

Figure 12:
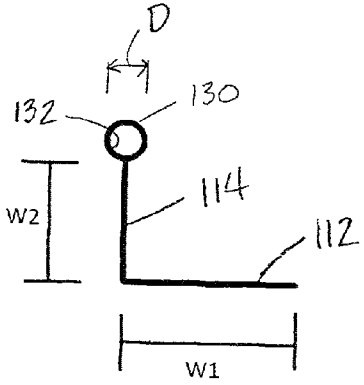
FIG. 12 is a top view of the safety gate hinge bracket.
Figure 13:
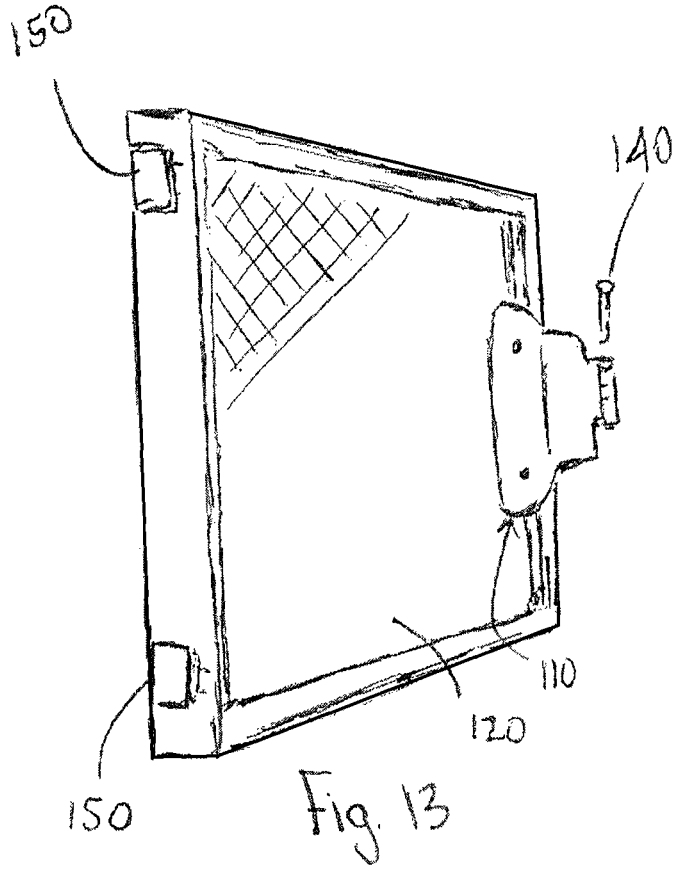
FIG. 13 is a perspective view of the safety gate hinge assembly engaging a door jamb with a locking connector to secure the safety gate within the door frame.
Figure 14:
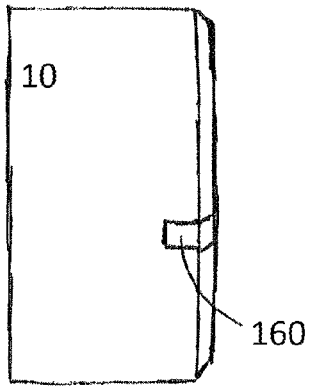
FIG. 14 is a perspective view of the door with a magnetic metal plate attached.
Figure 15:
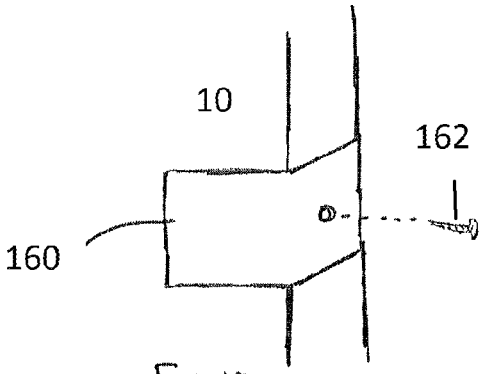
FIG. 15 is a magnified perspective view of the door with a magnetic metal plate attached.
Figure 16:
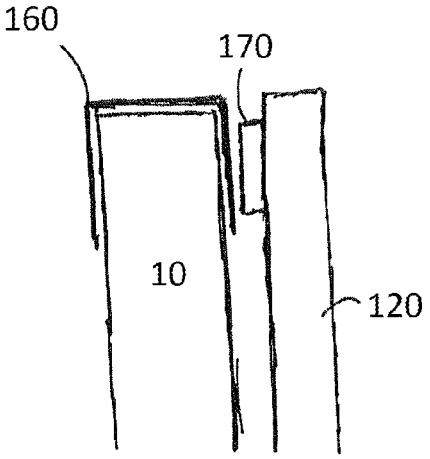
FIG. 16 is a schematic view of the door with a magnetic metal plate affixed thereto and the safety gate having a magnetic for releasable connection of the safety gate with the door.
Figure 17:
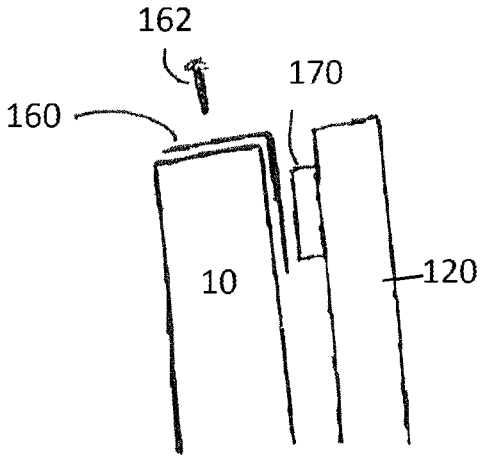
FIG. 17 is a schematic view of the door with a magnetic metal plate affixed with a connector and the safety gate having a magnetic for releasable connection of the safety gate with the door.

The inner edge 114*c* of the second hinge plate 114 of the L-shaped bracket is connected with the inner edge 112*c* of the first hinge plate 112. Two hinge connectors 130 are affixed to the second hinge plate 114, with the hinge connectors 130 in the embodiment illustrated in FIGS. 3, 6, and 11 being positioned along the outer edge 114*d* of the second hinge plate 114. Referring to FIG. 12, the hinge connectors 130 each have central aperture 132 that has a diameter D that is generally the same size as the apertures through the knuckles 36, 38 of the door hinge 30 so as to receive a lengthened bolt or screw 140 through the apertures. The bolt 140 is longer than the conventional door hinge pin or rod 40. The width W2 of the second hinge plate 114 is generally the same or a little larger than the width of the door 10 that is connected to the door hinges 30.

In operation, the user will select a door hinge 30 for mounting the safety gate hinge bracket 110, typically choosing the door hinge 30 that is closest to a floor surface to position the safety gate 120 near the floor surface. The user will then remove the existing hinge pin 40 from the knuckles 36, 38 of the door hinge 30. Next, the user will position and align the hinge connectors 130 above and below the knuckles 36, 38, and insert or slide the lengthened bolt 140 into the uppermost hinge connector 130*a*, through the knuckles 36, 38, and finally through the lowermost hinge connector 130*b*. The user may then further secure the lengthened bolt 140 in place with a nut (not illustrated) or similar device known in art positioned around the bolt 140 proximate the lowermost hinge connector 130*b*. With this assembly, both the door 10 and the safety gate 120 will be able to rotate about the lengthened bolt 140 independently.

Figure 8:
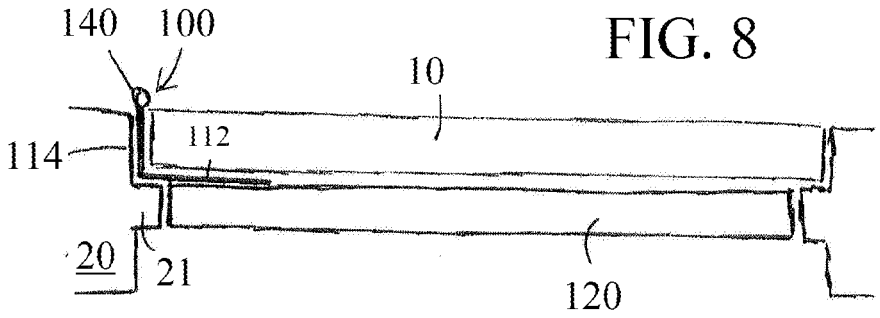
FIG. 8 is a top view of the safety gate hinge assembly engaging a door and door jamb, with the gate and door in a closed position.
Figure 9:
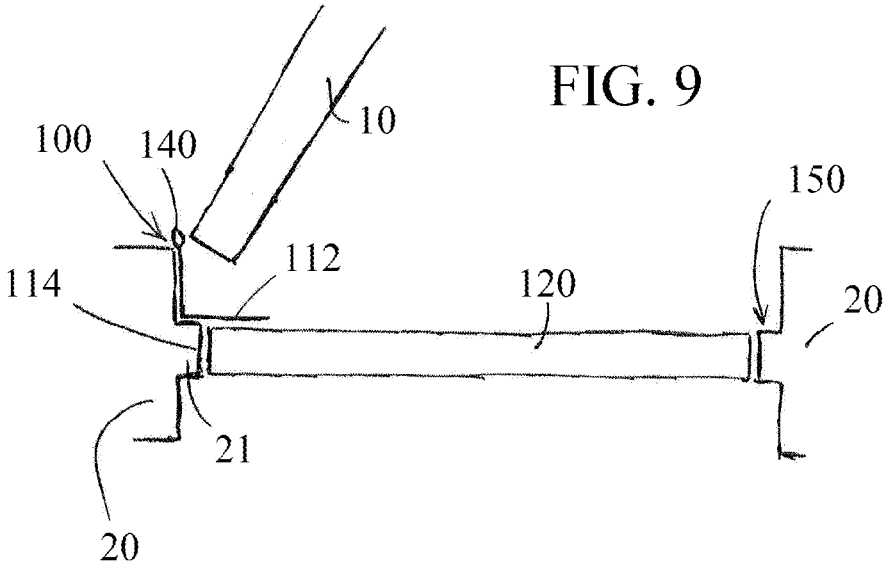
FIG. 9 is a top view of the safety gate hinge assembly engaging a door and door jamb, with the gate in a closed position and the door in an opened position.
Figure 10:
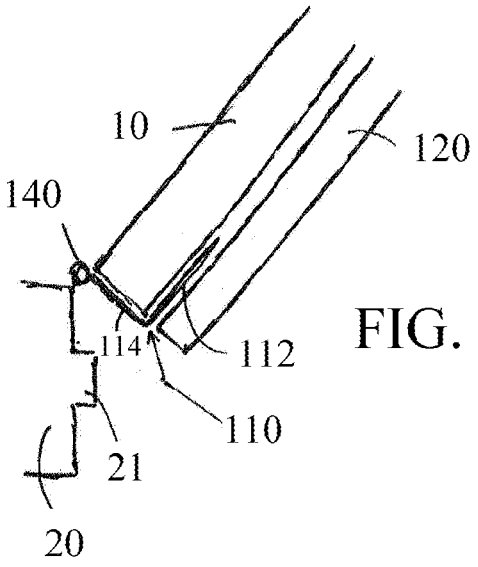
FIG. 10 is a top view of the safety gate hinge assembly engaging a door and door jamb, with the gate and door in an opened position.
Figure 11:
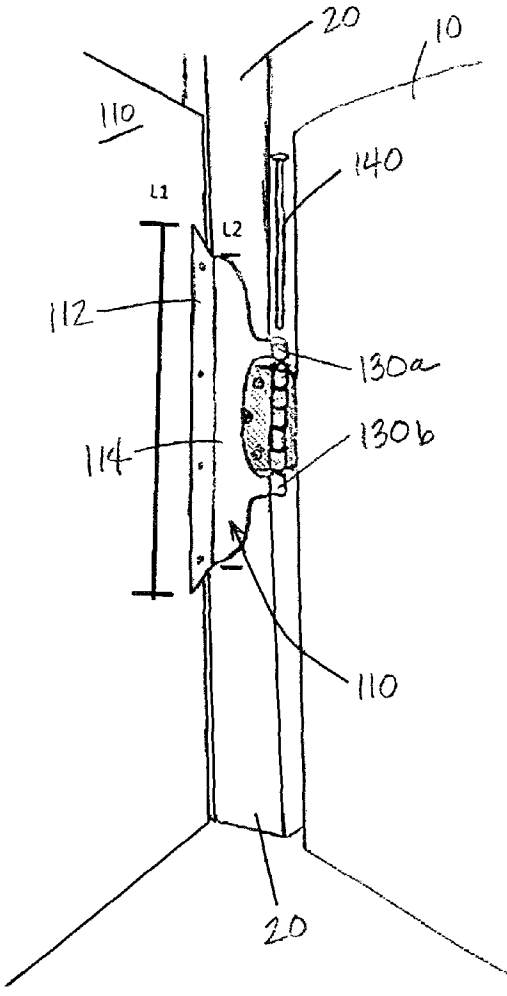
FIG. 11 is another perspective view of the safety gate hinge assembly engaging a door jamb.

FIGS. 8-10 illustrate the independent pivotal movement about pivot point P by both the safety gate 120 and the door 10. That is, since the safety gate 120 may pivot independently of the door 10 (and vice versa) about pivot point P, the user is able to open the door 10 but keep the safety gate 120 closed and locked in the door frame or jamb 20 for the desired purposes of securing and protecting children and pets. The user may also open the safety gate 120 in a conventional fashion. FIG. 8 illustrates the position of the door 10 and the safety gate 120 when both are in the closed position with respect to the door frame 20, and the door 10 substantially abuts the inner surface 116 of the safety gate hinge bracket 110. FIG. 9 illustrates the position of the door 10 when it is opened with respect to the door frame 20 but the baby gate 120 remains closed and locked in the door frame 20. Finally, FIG. 10 illustrates the position of the door 10 and the safety gate 120 when both are in the opened position with respect to the door frame 20. The shape of the safety gate hinge bracket 110 is such that the inner surface 116 of the safety gate hinge bracket 110 may snugly engage the edge of the door 10 when the door 10 is closed (see FIG. 8) or when the safety gate 120 is opened (see FIG. 10).

Figure 18:
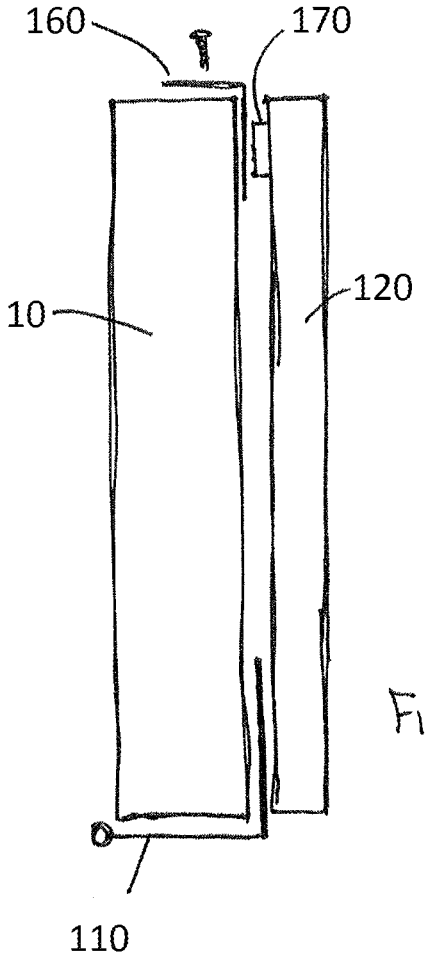
FIG. 18 is a schematic view of the door with a magnetic metal plate and hinge attachment, and the safety gate having a magnetic for releasable connection of the safety gate with the door.
Figure 19:
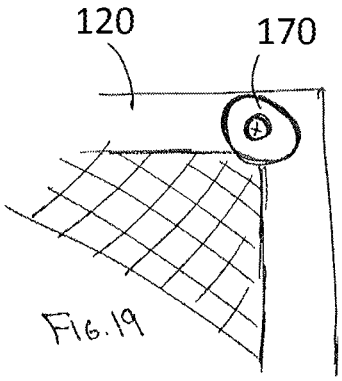
FIG. 19 is a perspective view of the safety gate with a magnet attached thereto.

It may be desirable to have the safety gate 120 detachably affixed to the door 10 when it is in the open position as shown in FIG. 10. This would prevent the unnecessary movement of the safety gate 120 when it is not latched or connected with the door frame 20. Referring to an embodiment shown in FIGS. 14-19, a magnet 170 may be affixed to the gate 120 to engage a magnetic material attached or associated with the door 10. As shown in FIG. 18, the magnet 170 may preferably be positioned on the safety gate 120 on the side opposite the safety gate hinge bracket 110. The magnet 170 may be affixed to the safety gate 120 using conventional methods, such as through an adhesive, screw, or other similar means. As shown in FIGS. 14-17, a metal plate 160 may be affixed to the door 10 via a screw 162, adhesive, pressed fit or other means, or the door 10 itself may be made of a magnetic material. The metal plate 160 is positioned on the door at a height corresponding to the position of the magnet 170 on the safety gate 120. The magnetic field produced by the magnet 170 is sufficient to keep the safety gate 120 releasably engaged and proximate the door 10 as the door is pivoted between an opened and closed position, but weak enough so that a user can easily dislodge the safety gate 120 from the door 10 and place the safety gate 120 in a locked position in the door frame 20. This embodiment therefore provides the additional benefit of prevent the safety gate 120 from pivoting unintentionally and creating an undesired noise.

Once the safety gate 120 is in the closed position, it can be locked in various ways. For example, if the safety gate 120 used in the safety gate assembly 100 is a telescopically adjustable safety gate as described above, then it will be held in place through a wedging or pressure action by extending the gate within the door jamb 20, and it may be removed by releasing the pressure. Referring to FIG. 9, the safety game assembly 100 may further include a means for closing and locking the safety gate 120 with the door frame 20. That is, a locking connector 150 known in the art, such as a latch or spring loaded door ball catch, may be affixed to the safety gate 120 and/or the door frame 20 to secure the closed position of the safety gate 120. Therefore, when the safety gate 120 is in the closed position with respect to the door jamb 20, the locking connector 150 affixed to the safety gate 120 will engage the door frame 20, or the locking connector 150 affixed to the door jamb 20 will engage the safety gate 120, to lock the safety gate 120 in place in the door jamb 20 (or both the safety gate 120 and the door jamb 20 might include corresponding connecting elements to engage each other for a locked safety gate 120). The position of the locking connector 150 will be to the door frame 20 opposite the door hinge 30 to securely but detachably lock the position of the safety gate 120.

Furthermore, while the embodiment illustrated shows a safety gate hinge bracket 110 that is independent from the safety gate 120, it is foreseen that another embodiment of the safety gate hinge bracket 110 may be molded into the safety gate 120 for immediate use with a standard door frame 20. In addition, while the safety gate hinge bracket 110 is shown as one single component, it is foreseen that it may be made of multiple independent plates that are secured or welded together.

It will be apparent to those skilled in the art that various modifications and variations can be made in the present methods and systems without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A safety gate hinge assembly for use in combination with a safety gate and a door, the door being connected to a door jamb using a single door hinge and door hinge pin, the assembly comprising:

a safety gate hinge bracket including a first plate and a second plate, the first plate and second plate having an outer surface and an inner surface;

a pair of hinge connectors attached to the second plate and separated by the single door hinge; and an extended hinge pin;

wherein the first plate is connected with the safety gate such that the outer surface abuts the safety gate; and wherein the extended hinge pin extends through the hinge connectors and the single door hinge to connect the safety gate hinge assembly.

2. The safety gate hinge assembly as described in claim 1 wherein said bracket is a substantially L-shaped bracket.

3. The safety gate hinge assembly as described in claim 1 wherein the first plate is positioned at substantially a right angle to the second plate.

4. The safety gate hinge assembly as described in claim 1 wherein the hinge connectors are connected to an outer edge of the second plate.

5. The safety gate hinge assembly as described in claim 1, wherein the extended hinge pin has an extended hinge pin length and the door hinge pin has a door hinge pin length, wherein the extended hinge pin length is greater than the door hinge pin length.

6. A safety gate assembly for use in combination with a primary door connected to a door frame using a single door hinge and door hinge pin, the door hinge pin having a length extending through said single door hinge, the safety gate assembly including:

a safety door;

a safety gate hinge bracket including a first plate and a second plate positioned at substantially a right angle to each other, the first plate connected to the safety door and having an outer surface and an inner surface;

a pair of hinge connectors attached to the second plate and separated by the single door hinge; and an extended hinge pin;

wherein the first plate is connected with the safety gate such that the outer surface abuts the safety gate; and wherein the extended hinge pin extends through the hinge connectors and the single door hinge.

7. The safety gate assembly as described in claim 6, wherein safety gate hinge bracket is L-shaped.

8. The safety gate assembly as described in claim 6 wherein the first plate is positioned at substantially a right angle to the second plate.

9. The safety gate assembly as described in claim 6 wherein the hinge connectors are connected to an outer edge of the second plate.

10. The safety gate assembly as described in claim 6 wherein the extended hinge pin has an extended length and the door hinge pin has a conventional length, the extended length being greater than the conventional length of the door hinge pin.

11. The safety gate assembly as described in claim 6 further comprising a locking connector to detachably connect the safety gate with the door frame.

12. The safety gate assembly as desired in claim 6 further comprising:

a magnet affixed to the safety door; and a magnetic material affixed to the door to releasably engage the magnet;

wherein the engagement between the magnet and magnetic material draws the safety door proximate the door.

13. A safety gate hinge assembly for use in combination with a safety gate and a door, the door being connected to a door jamb via a single door hinge and door hinge pin, the assembly comprising:

a safety gate hinge bracket including a first plate and a second plate, the first plate having an outer surface and an inner surface and the second plate having an outer surface and an inner surface;

an uppermost hinge connector and a lowermost hinge connector attached to the second plate and separated by the single door hinge; and an extended hinge pin;

wherein the first plate is connected with the safety gate such that the outer surface abuts the safety gate; and wherein the extended hinge pin extends through the uppermost hinge connector, the single door hinge, and the lowermost hinge connector to secure the safety gate hinge assembly to the single door hinge.

14. The safety gate hinge assembly as described in claim 13 wherein said bracket is an L-shaped bracket.

15. The safety gate hinge assembly as described in claim 14 wherein the first plate is positioned at substantially a right angle to the second plate.

* * * * *